United States Patent [19]

Davis et al.

[11] Patent Number: 4,874,660

[45] Date of Patent: Oct. 17, 1989

[54] PAPER MACHINE FELTS

[75] Inventors: Robert B. Davis, Framingham; Charles E. Kramer, Walpole; Sandra K. Barlow, Blackstone, all of Mass.

[73] Assignee: Albany Research (UK) Limited, Great Britain

[21] Appl. No.: 181,389

[22] Filed: Apr. 14, 1988

[30] Foreign Application Priority Data

Apr. 15, 1987 [GB] United Kingdom ..... 8709067

[51] Int. Cl.[4] ..... B32B 5/02

[52] U.S. Cl. ..... 428/234; 162/DIG. 1; 162/358; 428/280; 428/300; 428/287

[58] Field of Search ..... 162/DIG. 1, 358; 428/234, 287, 280, 300

[56] References Cited

U.S. PATENT DOCUMENTS

| | | | |
|---|---|---|---|
| 4,370,375 | 1/1983 | Bond | 162/358 |
| 4,427,734 | 1/1984 | Johnson | 428/234 |
| 4,565,735 | 1/1986 | Murka et al. | 428/234 |

*Primary Examiner*—James J. Bell

*Attorney, Agent, or Firm*—Ostrolenk, Faber, Gerb & Soffen

[57] ABSTRACT

The invention relates to an improved felt for a paper making machine having a batt formed from polyamide-12 needled to a woven base. The polyamide 12 batt may contain an antioxidant. The felts in accordance with the invention show much improved longevity and resistance to "flattening" in service.

10 Claims, No Drawings

PAPER MACHINE FELTS

DESCRIPTION

This invention relates to paper machine felts. In a paper making machine, a slurry of paper making constituents referred to as "furnish" is deposited on a fabric or "wire" and the liquid constituent is drawn or extracted therethrough to produce a self-cohesive sheet which is then passed to the pressing and drying sections of a paper making machine. In the pressing section, the paper sheet is transported by a felt to a pair of rollers where the felt and paper sheet pass between the nip of the rollers to dewater and to dry the paper sheet. The paper sheet itself may contain all types of chemical finishes and will be, at the same time, subjected to an elevated temperature to aid the dewatering and drying thereof. The paper making felt together with it's sheet of paper tends, therefore, to be subjected to immense pressure at elevated temperatures in a rigorous, chemical environment.

Paper making felts are generally produced by needling batt fibre to a woven backing which then support the forming paper sheet through the press. In the nip of the press rolls, these batt fibres are bent and deformed under great pressure and at great frequency; thus the mechanical properties of batt fibre are of considerable importance in such processes.

Polyamide 6 and polyamide 6,6 (PA-6, PA-6,6) have been used extensively in the manufacture of paper machine felts. These polymers are readily formable as fibres and their fibre characteristics can be controlled to make acceptable felts. Many prior art proposals for the use of polyamide materials in sheet and felt materials in general have been proposed. In British Patent Specification No. 1304732, for example, there is a reference to the use of polyamides such as nylon 6, nylon 66, nylon 6–10, nylon 7, nylon 8, nylon 9, nylon 11 and nylon 12. The specification is concerned with the manufacture of a fibre sheet material and is not specifically concerned with paper machine clothing.

British Patent Specification No. 1329132 again relates to a non-woven fabric for use, for example, as an interlining. Again, there is reference to the use of polyamides such as nylon 6, nylon 11, nylon 12 and copolyamides such as nylon 6/66 and copolymers of nylon 6 and nylon 66 with nylon 11 or nylon 12.

British Patent Specification No. 1585632 has been concerned with the manufacture of artificial leather and like materials and again, the use of nylon 6, nylon 66, nylon 10, nylon 11 and nylon 12 are disclosed together with various copolymers of different variations and combinations thereof.

In each of these cases referred to the nylon materials are used primarily for their inherent strength in a clothing or decorative assembly and would not be subjected to the agressive physical and chemical environment of a paper making machine.

European Patent Specification No. 0070708 relates to a paper making felt comprising a woven heat set belt of machine and transverse direction of thermoplastic filaments in which the filaments in at least one of the machine and transverse directions are co-extruded and monofilaments having a core of a polymer selected from nylon 66, polyethylene teraphthlate and a tetrapolymer of a tere- or isophthalic acid and a sheet of a copolymer selected from nylon 11, nylon 12, nylon 6, nylon 6,10, nylon 6,12, polybutylene terephthalate and a large number of other materials.

In European Patent Specification No. 0070708 the materials are being employed principally for their well known properties of strength and abrasion resistance.

As paper machine technology improves, speeds, operating temperatures and pressures increase with a result that the tendency of existing felts to flatten is also increased. Further, increased degradation with increasing temperature of operation and increasing speed of the machine results in a shorter service life of paper machine felts.

The present applicants have discovered surprisingly that a batt layer formed from fibres of polyamide 12 formed by the extrusion of a melt of polyamide 12 having an intrinsic viscosity greater than 0.6 dl/g has been found to have unexpectedly improved properties for use in paper making machine felts.

According to the present invention, therefore, there is provided a felt for use in a paper making machine comprising a woven base and at least one layer of batt fibre needled thereto characterised in that the said batt fibre comprises fibres of polyamide 12 formed by the extrusion of a melt of polyamide 12 having an intrinsic viscosity of not less than 0.6 dl/g. In a preferred embodiment of the invention the melt contains 0.2 to 1.0% by weight of antioxidant, and more preferably 0.4 to 0.6%, the antioxidant may be selected from one or more of the following: alpha-tocopherol, condensation products of diphenylamine and acetone and multifunctional amide containing phenolic antioxidants.

Accordingly, such fibres may be conventionally crimped, cut to length, carded and lapped prior to needling. It is preferred that the fibre has a draw ratio greater than 1.5 and preferably within the range of 2 to 4. In a further aspect of the invention the shute and/or warp filaments of the woven base of the felt may be also formed of PA-12 having an intrinsic viscosity greater than 0.6 dl/g. In another aspect of the present invention, the intrinsic viscosity of the melt from which the fibres are formed is greater than 0.7 dl/g.

Polyamide 12 can be extruded to reasonable tensile properties compatible with its utilisation in all three product types of paper machine clothing, namely those for use in the dewatering, pressing and drying sections of the machine. If continuous filament is crimped to a level of 3 to 7 crimps per centimeter and is cut into conventional staple lengths, PA-12 can be formed into batts and needled to a woven base. Such felts have been found to be excellent in a pressing or mid-section of a paper making machine.

In another aspect of the invention monofilaments may be used in the preparation of the woven fabrics. As a monofilament having a diameter within the range of 0.10 to 0.25 mm, it may be used in the preparation of Fourdrinier or forming fabrics. With a diameter of 0.2 to 2.0 mm, polyamide 12 may be used as monofilaments compatible with dryer screen fabrics for the dryer end of paper making machine and the continuous filaments or yarns having dimensions approximately 2.5 to 40 or greater denier per filament, it may be employed in both dryer screen and press felt base weave applications.

Fibres for use in the present invention are suitable for all the paper making machine applications indicated above in both monofilament and continuous filament or staple fibre form. The filaments themselves exhibit a surprisingly high degree of abrasion and chemical resistance, fabric dimensional stability and recovery from deformation. The present Applicants have found surprisingly that polyamide 12 is particularly useful in the areas of compression, and fatigue testing in which it shows superior properties to the other nylon materials. For example, in one aspect of the invention, fibres for use in the invention may have a degree of relative compaction after 530,000 compressions of less than 2.6 on a relative and arbitrary scale of 0 (uncompacted) to 5 (fully compacted). Such testing can be performed on a laboratory device simulating paper machine processing.

Filaments and fibres in accordance with the present invention together with their various additives may be compounded during extrusion of monofilament or continuous filament by the addition of the selected antioxidant and additives at the time of extrusion.

In accordance with the present invention a PA-12 filament with additives may be extruded at temperature profiles along the extrusion barrel of between 200° C. and 275° C. The spinneret may be maintained at 300° C. Monofilament may be extruded with a draw down in order to provide monofilaments of 0.1–0.25 mm for the manufacture of paper machine fabrics.

Filaments and fibres for use in the present invention have a low moisture regain (less than 1% mass on mass) and are relatively insensitive in terms of changes in physical properties in the presence of water.

In one aspect of the present invention, the use of batt and base layers of press felts formed of polyamide-12 in accordance with the present invention containing appropriate antioxidants, demonstrate superior durability due to enhanced recovery from compression and resistance to abrasion. There is a significant improvement in chemical resistance particularly in terms of resistance to hydrolysis and degradation of physical properties caused by hypochlorite or hydrogen peroxide oxidation in paper machine clothing. Fibers show increased resistance to abrasion damage resulting from the pressing of papers containing fillers. Such felts exhibit 50% to 100% longer lifetime in use, in particularly hostile chemical and abrasive environments.

Following is a description by way of example only of methods of carrying the invention in to effect:

EXAMPLE 1

Commercially available PA-12 having an intrinsic viscosity of 0.76 dl/g in concentrated sulfuric acid was purchased as pellets from Emser Grilon-USA, S.C. These polyamide pellets or chips were vacuum dried. Pellets were transferred to the hopper of a single screw extruder. The extruder was equipped with a one inch diameter polyamide screw. The extruder was fitted with a filter pack of 55 micron nominal porosity. Downstream of the filter the extruder was fitted with a gear pump metering the melt to a spinneret. The spinneret had 20 holes, each of diameter 1.5 mm. The extruder had a temperature profile ranging from 200° C. at the hopper throat to 275° C. at the pump with 5 zones of independent temperature monitoring and control. The spinneret was maintained at 305° C. Filaments were extruded at approximately 30 m/min with a maximum draw-down such that the radial change was approximately 7 to 8 between spinneret and the first Godet. Yarn was taken up on a cylinder attached to a Leesona winder after the Godet.

Typical fiber as-spun according to this procedure was drawn in two stages with a third stage of relaxation, all with heat, to provide an overall 2.0 times draw ratio. The first temperature of drawing was at 110° C.; the second at 125° C.; relaxation occured in the third stage at 160° C. Fibre from such a process was prepared to 15.3 dpf (denier per filament). The fibre thus prepared had 4.0 gpd tenacity with an initial modulus of 23.1 gpd and an elongation at break of 58%. The stress-strain curve exhibited a deflection at an elongation of 12% at 3 gpd specific stress.

Such fiber was crimped in a heated stuffer box crimper to provide continuous yarn with a variable random crimp of approximately 3 crimps/cm. It was cut into staple of approximately 4 cm lengths. Such fibre was carded, lapped and needled into a press felt to provide a batt structure at an overall batt weight of approximately 1000 g/m$^2$. Such a felt exhibited at least 50% or more increased life in comparison to similar PA-6 felts when challenged with identical conditions in a simulated papermaking device.

In addition individual filaments were subject to a biaxial rotational fatigue test as described in the article: S. F. Calil, B. C. Goswami and J. W. S. Hearle, J. Phys. V:Appl Phys., 13, 725(1980) (hereinafter referred to as the Calil Test) In such a test at 15 dpf, individual filaments loaded at 1.3 gpd and rotated under water at 60° C. show superior durability over the entire length of test beyond PA-6 and PA-6,6 of similar denier with the same normalized loadings. In such a test all PA-6 and PA-6,6 fibres had failed by 8000 revolutions by which time only 40% of all PA-12 fibres tested had failed. Twenty percent of all PA-12 fibers remained after 10,000 cycles.

EXAMPLE 2

Fibres were prepared as described in Example 1 with the following modifications. Prior to drawing, pellets were tumbled with powdered Irganox 1098 (Ciba-Geigy) at a loading such that the blend was 0.5% wt/wt. Pellets which appeared to be uniformly coated with the powdered antioxidant were to transfered to the hopper. UV analysis of the as-spun fibre indicated a uniform concentration in several samples tested at a concentration of approximately 0.5% wt/wt. The lifetime of the felt was increased beyond that of a normal commercial felt by at least 20% on a simulated paper making device. Lifetime as exemplified by a flex test (Calil Test) on individual filaments showed an increased lifetime of approximately 50% greater than PA-6 and PA-6,6 filaments similarly treated.

PA-12 fibre with antioxidant showed increased retention of tensile strength after subjected to thermal ageing in recirculating ovens maintained at 160° C. After 25 hours unprotected PA-12 fibre had lost 75% of its initial tensile strength; intrinsic viscosity had dropped 0.57 dl/g. PA-12 fibre with Irganox 1098 retained greater than 60% of its original tensile strength after such heat treatment; it's intrinsic viscosity had dropped only 0.06 dl/g.

EXAMPLE 3

Polymer samples were prepared for testing. The intrinsic viscosity of each polymer sample was measured and fibres were prepared as batt samples. Individual samples were then subjected to various tests as follows:

(i) a simulated papermaking compression test in which a sample is subjected to repeated compression for a given number of cycles and were reviewed and judged on a relative felt ranking on a scale of 0 to 5;

(ii) a chemical degradation in which a sample of batt fibres is subjected to the presence of sodium hypochlorite in a concentration of 250 miligrams per liter at 38° C. for 6 hours at a pH of 8 and retained intrinsic viscosities are compared;

(iii) a second degradation test in which a sample of each fibre was treated to a 35% solution of hydrogen peroxide for 24 hours at 60° C. at pH 2 and the retained intrinsic viscosities are compared.

Fibers from each material were then subjected to the Calil Test referred to above.

The tests are set out in the accompanying Table 1.

The fibres tested were a polyamide 12 spun according to Example 1 with and without the antioxidant Irganox 1098, and in relatively low and high molecular weights.

These materials were compared and contrasted with standard polyamide 6,6 available from Messrs. DuPont under the reference DUPONT T 100 and a polyamide 6 commercially available from Messrs. Grilon under the trade name GRILON TN 12R.

Examination of the table will show that the polyamide 12 samples gave superior properties and the experimental test data shows clearly that by selecting the intrinsic viscosity of the polyamide 12 above 0.6 the simulated papermaking press data gives improved ranking. According to the tables, the lower the ranking, the better the results. It will be seen further that the polyamide 12 does not tend to degrade under severe chemical conditions whereas each of the polyamide 6 and polyamide 6,6 show significant deterioration particularly in the hydrogen peroxide treatment. These latter properties are extremely important since the use of hydrogen peroxide in paper making is increasing.

The compression test results show that on a relative test of degradation, the felts in accordance with the present invention are comparable with the best of the standard press felts in terms of longevity, show much improved fatigue properties and thus resistance to fibrillation while the chemical stability particularly in terms of hydrogen peroxide is much enhanced over the current production.

TABLE 1

| SAMPLE DESCRIPTION | INTRINSIC VISCOSITY | PAPERMAKERS PRESS Relative Ranking (Scale 0–5) (530,000 cycles) | CALIL TEST Median cycles to break | CHEMICAL STABILITY RETAINED INTRINSIC VISCOSITY (%) NA HYPOCHLOR | $H_2O_2$ | DRY HEAT STABILITY AT 160° C. 25 hours RETAINED STRENGH (%) | INTRINSIC VISCOSITY (%) |
|---|---|---|---|---|---|---|---|
| PA-12 (i) HMW 16.2 dpf | 0.76 | 2.6 | 10,682 | 81 | 83 | 23 | 0.19 |
| PA-12 (ii) HMW PA-12/pH AOx 17.1 dpf | 0.80 | — | 7,810 | 75 | 85 | 64 | 0.74 |
| PA-12 LMW 6.0 dpf | 0.56 | 4.0 | — | — | 90 | | |
| PA-6,6 DUPONT T 100 15 dpf | 1.35 | 2.7 | 2,360 | 61 | 47 | 11 | 0.36 |
| PA-6 GRILON TN12R 13 dpf | 1.47 | 3.0 | 6,075 | 51 | 31 | 87 | 1.35 |

NA HYPOCHLORITE - 250 mg/l 38° C. 6 hours pH = 8
HYDROGEN PEROXIDE - 37% $H_2O_2$; 24 hours; 60° C.; pH = 2

We claim:

1. A felt for use in a paper making machine comprising a woven base and at least one layer of batt fibre needled thereto, characterised in that said batt fibre comprises fibres of polyamide-12 formed by the extrusion of a melt of polyamide-12 having an intrinsic viscosity of not less than 0.6 dl/gm.

2. A felt as claimed in claim 1 characterised in that said melt contains 0.2 to 1.0% by weight of antioxidant.

3. A felt as claimed in claim 2 characterized in that the amount of antioxidant is 0.4 to 0.6%.

4. A felt as claimed in claim 1 characterised in that said melt contains an antioxidant selected from the group consisting of alpha-tocopherol, condensation products of diphenylamine and acetone and multifunctional amide containing phenolic antioxidants.

5. A felt as claimed in claim 4 characterized in that said melt contains 0.2 to 1.0% by weight of antioxidant.

6. A felt as claimed in claim 5 characterized in that the amount of antioxidant is 0.4 to 0.6%.

7. A felt as claimed in claim 6 characterized in that said intrinsic viscosity is greater than 0.7.

8. A felt as claimed in claim 1 characterised in that at least one of the shute and warp filaments of the woven base is formed of polyamide-12.

9. A felt as claimed in claim 1 characterized in that said intrinsic viscoisity is greater than 0.7.

10. A felt as claimed in claim 9 characterized in that the amount of antioxidant is 0.4 to 0.6%.

* * * * *